US011041593B2

(12) United States Patent
Yang et al.

(10) Patent No.: US 11,041,593 B2
(45) Date of Patent: Jun. 22, 2021

(54) LIGHTING DEVICE

(71) Applicant: LG INNOTEK CO., LTD., Seoul (KR)

(72) Inventors: Hyun Duck Yang, Seoul (KR); Seong Jin Kim, Seoul (KR); Eay Jin Lim, Seoul (KR); Kwang Ho Park, Seoul (KR); Jae Hyuk Jang, Seoul (KR); Young Jae Choi, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 17/004,580

(22) Filed: Aug. 27, 2020

(65) Prior Publication Data

US 2020/0393092 A1 Dec. 17, 2020

Related U.S. Application Data

(63) Continuation of application No. 16/482,422, filed as application No. PCT/KR2018/001426 on Feb. 2, 2018, now Pat. No. 10,788,169.

(30) Foreign Application Priority Data

Feb. 2, 2017 (KR) ..... 10-2017-0014925

(51) Int. Cl.
*F21K 9/65* (2016.01)
*F21K 9/68* (2016.01)
(Continued)

(52) U.S. Cl.
CPC ..... *F21K 9/65* (2016.08); *F21K 9/68* (2016.08); *F21K 9/69* (2016.08); *F21V 3/02* (2013.01);
(Continued)

(58) Field of Classification Search
CPC ..... F21K 9/65; F21K 9/68; F21K 9/69; F21S 43/19; F21S 43/15; F21V 5/005;
(Continued)

(56) References Cited

U.S. PATENT DOCUMENTS

2014/0133128 A1 5/2014 Oh
2015/0092389 A1 4/2015 Harkins
(Continued)

FOREIGN PATENT DOCUMENTS

KR 10-2016-0132175 11/2001
KR 10-2014-0061666 5/2014
(Continued)

OTHER PUBLICATIONS

International Search Report dated May 29, 2018 issued in Application No. PCT/KR2018/001426.
(Continued)

*Primary Examiner* — Caridad Everhart
(74) *Attorney, Agent, or Firm* — KED & Associates LLP

(57) ABSTRACT

An embodiment provides a lighting device comprising: a conversion unit including an optical layer having a plurality of optical patterns; a light emitting element for emitting light toward the optical patterns; and a circuit board on which the light emitting element is disposed, wherein the plurality of optical patterns are spaced apart from each other in a first direction and extend in a second direction intersecting the first direction, and the optical layer has a curvature in the first direction.

16 Claims, 9 Drawing Sheets

(51) Int. Cl.

| | |
|---|---|
| ***F21S 43/19*** | (2018.01) |
| ***F21S 43/15*** | (2018.01) |
| ***F21K 9/69*** | (2016.01) |
| ***F21V 3/02*** | (2006.01) |
| ***F21V 13/04*** | (2006.01) |
| *F21Y 105/12* | (2016.01) |
| *F21Y 115/10* | (2016.01) |

(52) U.S. Cl.
CPC ..... *F21V 13/04* (2013.01); *F21Y 2105/12* (2016.08); *F21Y 2115/10* (2016.08)

(58) Field of Classification Search
CPC ..... H01L 33/62; H01L 33/44; H01L 33/20; H01L 33/38; H01L 2224/14; H01L 2224/48091; H01L 2924/00014
See application file for complete search history.

(56) References Cited

U.S. PATENT DOCUMENTS

| | | | | |
|---|---|---|---|---|
| 2015/0184829 | A1 | 7/2015 | Baek et al. | |
| 2015/0276145 | A1* | 10/2015 | Wang ..... | F21K 9/60 362/235 |

FOREIGN PATENT DOCUMENTS

| | | |
|---|---|---|
| KR | 10-2014-0078372 | 6/2014 |
| KR | 10-2015-0076552 | 7/2015 |

OTHER PUBLICATIONS

Office Action dated Feb. 21, 2020 issued in parent U.S. Appl. No. 16/482,422.

* cited by examiner

LIGHTING DEVICE

CROSS-REFERENCE TO RELATED APPLICATIONS

This application is a Continuation Application of U.S. patent application Ser. No. 16/482,422 filed Jul. 31, 2019, which is a U.S. National Stage Application under 35 U.S.C. § 371 of PCT Application No. PCT/KR2018/001426, filed Feb. 2, 2018, which claims priority to Korean Patent Application No. 10-2017-0014925, filed Feb. 2, 2017, whose entire disclosures are hereby incorporated by reference.

BACKGROUND

1. Field

An embodiment relates to a lighting device.

2. Background

A light emitted diode (LED) element is an element configured to convert an electrical signal to infrared rays or light using a compound semiconductor characteristic, and it is advantageous in that environmental pollutants are less because harmful materials such as mercury or the like are not used unlike a fluorescent light, and a lifespan is greater than those of conventional light sources. Further, it is advantageous in that visibility is greater and power consumption is low due to a high color temperature in comparison with the conventional light sources.

A lighting device has developed from a type using a conventional light source such as a conventional fluorescent light to a type using an LED light source due to the development and dissemination of LED technology. For example, as disclosed in Korean Laid-Open Patent No. 10-2012-0009209, a lighting device configured to perform a surface light emission function using an LED light source, a light guide plate, or the like has been proposed.

Further, in some conventional technologies, a lighting device having an improved surface light emitting performance by adding an optical sheet such as a diffusion sheet, a prism sheet, a protective sheet, or the like on a light guide plate has been proposed.

However, the conventional lighting device using the LED light source has a limitation in reducing an overall thickness of a product due to a thickness of a light guide plate itself, a material of the light guide plate itself is not flexible and thus is difficult to apply to a housing or application in which the light guide plate is bent, and it has a disadvantage that product design and design modification are not easy due to the light guide plate. As described above, a method which can be easily applied to various applications such as indoor and outdoor lighting, vehicle lighting, or the like and can efficiently implement a desired optical image is in demand.

Recently, although a lighting device thinned by disposing a resin layer on a board on which an LED is disposed has been developed, with the above structure, a lighting image may become inferior due to a resin surface and inner foreign substances (for example: bubbles), and since a large-sized circuit board is necessary for the application of a resin, manufacturing costs increase.

BRIEF DESCRIPTION OF THE DRAWINGS

The embodiments will be described in detail with reference to the following drawings in which like reference numerals refer to like elements wherein.

DETAILED DESCRIPTION

The embodiments may be modified into other forms or some of the embodiments may be combined, and the scope of the present invention is not limited to embodiments which will be described below.

Although items described in a specific embodiment are not described in another embodiment, the items may be understood as a description related to the other embodiment unless a description opposite or contradictory to the items is in the other embodiment.

For example, when a characteristic of a configuration A is described in a specific embodiment and a characteristic of a configuration B is described in another embodiment, the characteristics of the configurations are understood to fall within the scope of the present invention unless an opposite or contradictory description is present even when an embodiment in which the configuration A and the configuration B are combined is not clearly disclosed.

In the description of the embodiments, when one element is disclosed to be formed "on or under" another element, the term "on or under" includes both a case in which the two elements are in direct contact with each other and a case in which at least another element is disposed between the two elements (indirectly). Further, when the term "on or under" is expressed, a meaning of not only an upward direction but also a downward direction with respect to one element may be included.

Hereinafter, embodiments of the present invention will be described in detail with reference to the accompanying drawings so that those skilled in the art may easily carry out the embodiment of the present invention.

Figure 1:
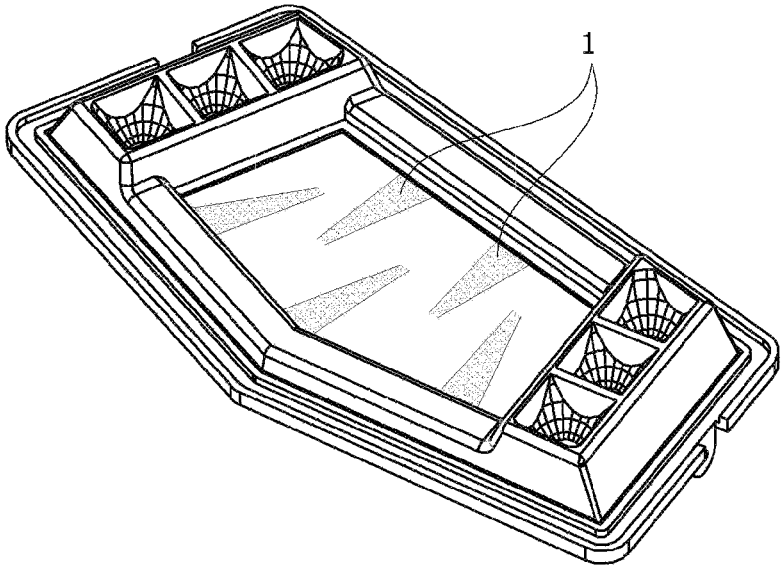
FIG. 1 is a perspective view of a lighting device according to an embodiment of the present invention.
Figure 2:
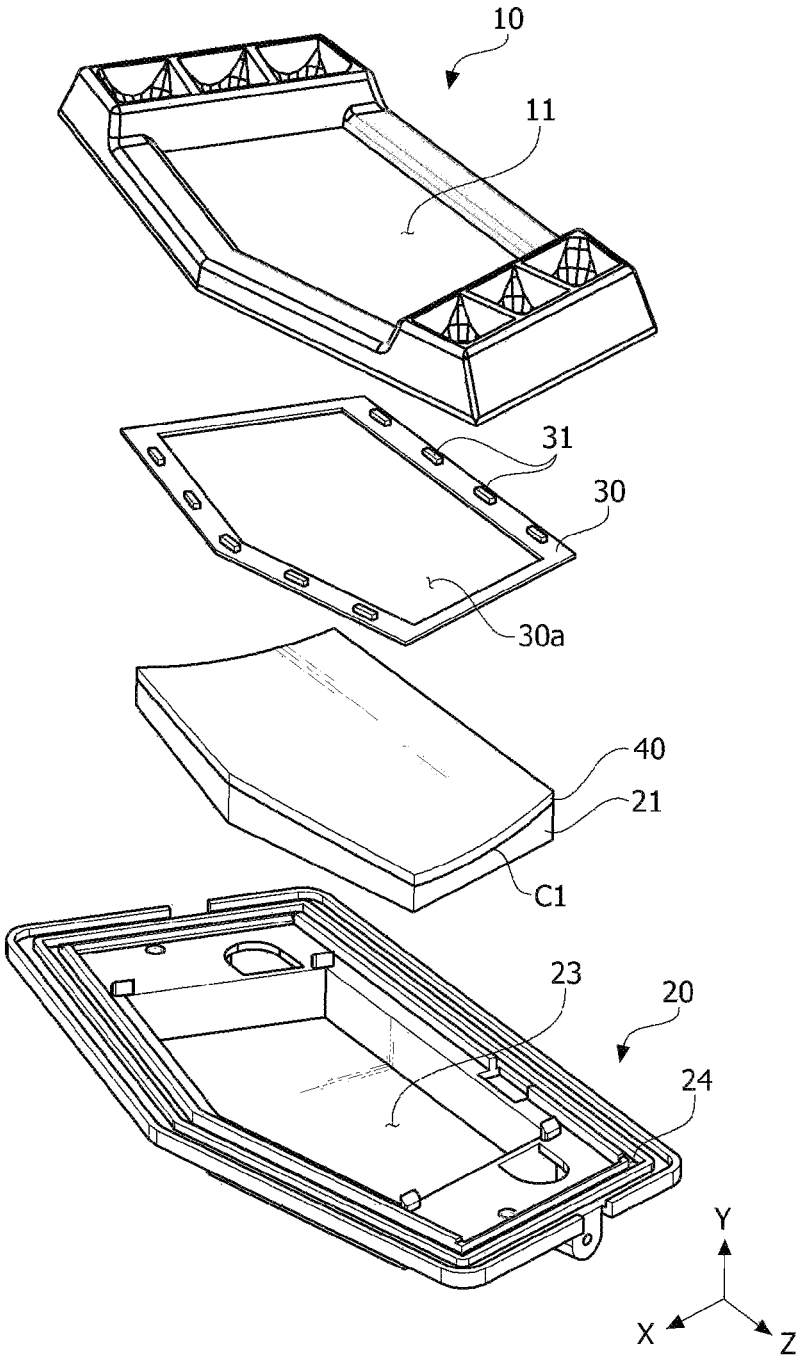
FIG. 2 is an exploded perspective view of FIG. 1.

FIG. 1 is a perspective view of a lighting device according to an embodiment of the present invention, and FIG. 2 is an exploded perspective view of FIG. 1.

Referring to FIGS. 1 and 2, a lighting device according to the embodiment may include a bracket 20, a conversion unit 40 disposed on the bracket 20, a circuit board 30 on which light emitting elements 31 are disposed, and a cover 10 coupled to the bracket 20.

The conversion unit 40 may convert light emitted from the light emitting elements 31 to linear light 1. The linear light may be defined as light in which a plurality of point light sources are recognized in the form of lines by an observer. The linear light may be stereoscopic light. The observer may recognize that one side of the linear light is moving away or approaching. That is, the observer may feel the depth of the linear light.

The bracket 20 may include a first accommodation part 23 in which the conversion unit 40 is disposed and a second accommodation part 24 in which the circuit board 30 is disposed. A depth of the first accommodation part 23 may be greater than a depth of the second accommodation part 24. The type and shape of the bracket 20 are not particularly limited. For example, the bracket 20 may have various bracket shapes used in a vehicle lamp.

The cover 10 may have an opening 11 formed at a center thereof to expose the conversion unit 40 and cover the second accommodation part 24. A shape of the cover 10 is not particularly limited. The shape of the cover 10 may correspond to the shape of the bracket 20.

A block 21 may support the conversion unit 40. A curvature C1 may be formed in one surface of the block 21. Accordingly, the conversion unit 40 disposed on one surface of the block 21 may also have a curvature. The other surface of the block 21 may have a flat surface but is not limited thereto. According to the embodiment, the blocks 21 having various curvatures may be selectively disposed. For example, a first block in which a curvature radius of one surface is 500R, a second block in which a curvature radius of one surface is 300R, a third block in which a curvature radius of one surface is 100R, and the like which are the blocks 21 may be selectively disposed. Accordingly, a desired block is inserted to variously change a curvature radius of the conversion unit 40. However, the present invention is not limited thereto and the block 21 may be integrally formed with the bracket 20.

The circuit board 30 may be disposed at an outer side of the conversion unit 40. A structure in which a light emitting element and a conversion unit are disposed on a circuit board having a predetermined area and a resin layer is disposed thereon has a problem that the area of the circuit board is large. However, according to the embodiment, since the resin layer is omitted and the circuit board 30 is disposed at the outer side of the conversion unit 40, the circuit board 30 may have only an area on which the light emitting element 31 is disposed. Accordingly, manufacturing costs are reduced and since a process of applying and curing the resin is omitted, a manufacturing process may also be simplified.

For example, an outer shape of the circuit board 30 and a shape of an inner groove 30*a* may be the same. When the outer shape of the circuit board 30 is a pentagonal shape, the inner groove 30*a* may also have a pentagonal shape. However, the present invention is not limited thereto and the outer shape of the circuit board 30 and the shape of the inner groove may be different from each other. Further, the circuit board 30 may have a structure in which a plurality of bar-shaped sub circuit boards are disposed.

The shape of the inner groove 30*a* of the circuit board 30 may correspond to the outer shape of the block 21. For example, when the block 21 has a pentagonal shape, the inner groove 30*a* of the circuit board 30 may also have a pentagonal shape. Accordingly, since the block may be inserted into the inner groove 30*a*, the light emitting elements 31 may be disposed on a side surface of the block 21.

A shape of the conversion unit 40 may be variously manufactured according to a lighting image of the vehicle lamp. The shape of the conversion unit 40 may correspond to the shape of the block 21.

Figure 3:
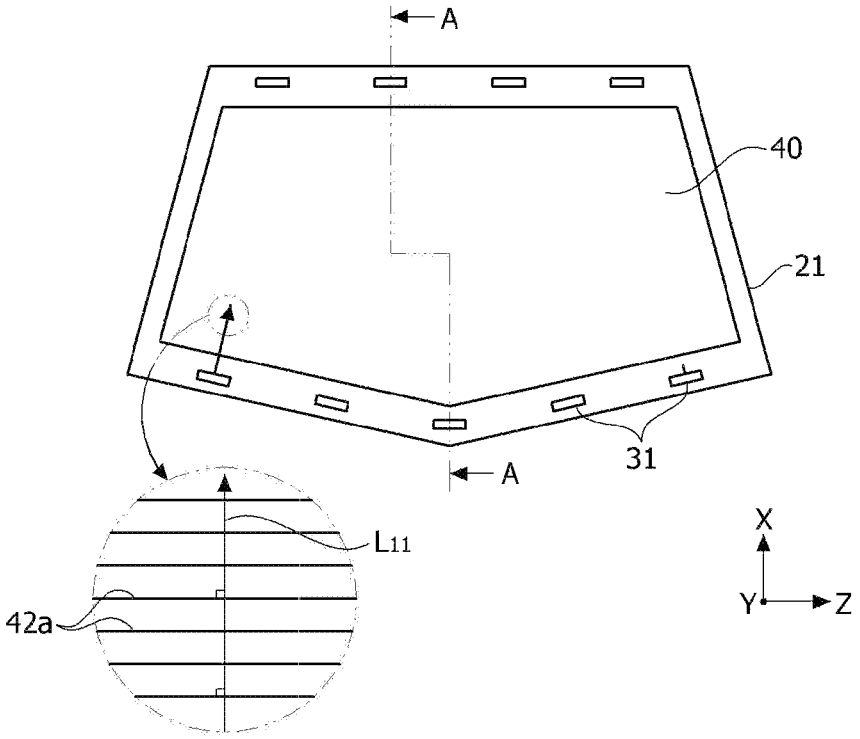
FIG. 3 is a plan view of the lighting device.
Figure 4:
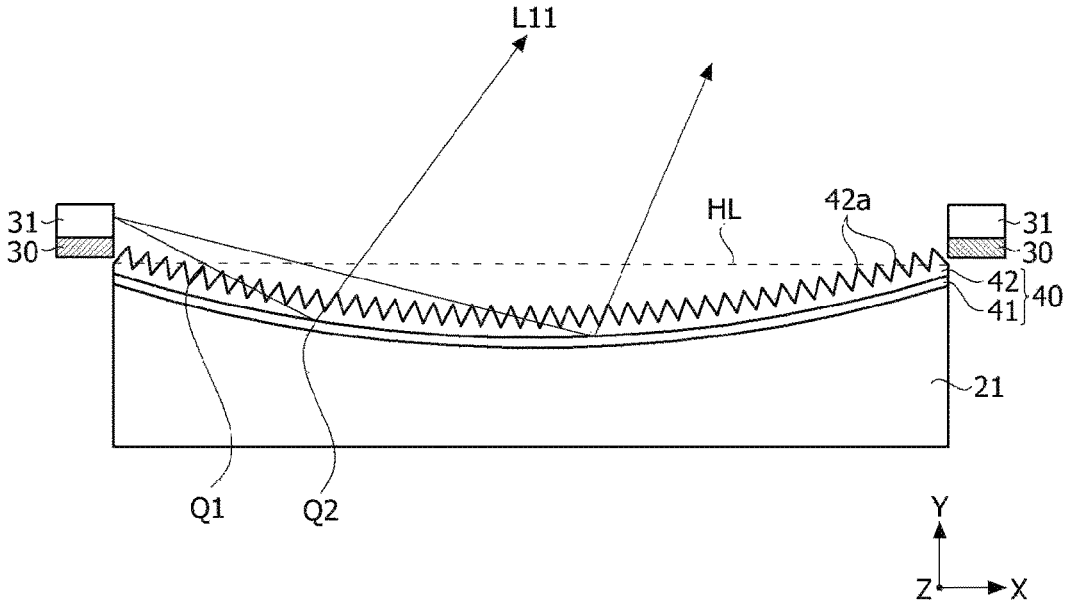
FIG. 4 is a cross-sectional view taken along direction A-A in FIG. 3.

FIG. 3 is a plan view of the lighting device, and FIG. 4 is a cross-sectional view taken along direction A-A in FIG. 3.

Referring to FIGS. 3 and 4, the lighting device according to the embodiment includes a conversion unit 40 including an optical layer 42 having a plurality of optical patterns 42*a*, a circuit board 30 disposed on a side surface of the optical layer 42, and a plurality of light emitting elements 31 disposed on the circuit board 30.

The conversion unit 40 may include a reflective layer 41, and the optical layer 42 disposed on the reflective layer 41. The conversion unit 40 may serve to convert light L11 emitted from a light source to linear light. The linear light may lead to a feeling of depth in a thickness direction of the conversion unit 40 (a Y-axis direction). That is, an observer may observe only light which proceeds in directions practically vertical to extending directions of the optical patterns 42*a*. Further, the observer may recognize that the linear light is moving away or approaching as moving in one direction.

The reflective layer 41 may be disposed on one surface of the bracket. The reflective layer 41 may reflect light emitted from the light emitting elements 31 by including a material having high reflective efficiency. The lighting device may reduce light loss and more clearly show linear light having a stereoscopic effect due to the reflective layer 41.

In the reflective layer 41, a synthetic resin dispersedly containing a white pigment may be used to increase the reflection characteristics of light and the characteristics of promoting the dispersion of light. For example, the white pigment may include titanium oxide, aluminum oxide, zinc oxide, carbonate, barium sulfate, calcium carbonate, and the like. A synthetic resin raw material may include polyethylene terephthalate, polyethylene naphthalate, acrylic, polycarbonate, polystyrene, polyolefin, cellulose acetate, weather-resistant vinyl chloride, and the like, but is not limited thereto. In another embodiment, the reflective layer 41 may include silver (Ag), aluminum (Al), stainless steel, and the like.

The optical layer 42 may include a plurality of optical patterns 42*a* spaced apart from each other in a first direction (an X-axis direction) and configured to extend in a second direction (a Z-axis direction). The optical pattern 42*a* may have an engraved or embossed lens shape configured to extend in the second direction (the Z-axis direction), but is not limited thereto. For example, a cross section of the optical pattern 42*a* may be a prism shape.

The board 30 may be a circuit board capable of applying external power to the light emitting elements 31. For example, in the board 30, a circuit pattern may be formed in a ceramic body, but is not limited thereto.

The light emitting element 31 may be a light emitting diode or an organic light emitting diode. The light emitting element 31 may emit light in a blue wavelength range, a green wavelength range, or a red wavelength range. Selectively, a wavelength conversion layer (not shown) such as a phosphor may be disposed on the light emitting element 31.

In the lighting device according to the embodiment, a resin layer covering the light emitting element 31 and the conversion layer may be omitted. When the resin layer is present, the light emitted from the light emitting elements 31 may mainly move in the first direction (the X-axis direction). However, in the embodiment without the resin layer, only some of the light emitted from the light emitting elements 31 may be incident on the conversion unit 40 and converted to linear light. That is, a length of the linear light relatively decreases and the intensity of the linear light may be weakened.

Accordingly, the optical layer 42 according to the embodiment may have a curvature. The curvature may be concavely formed toward the block 21 based on a horizontal plane HL. That is, a separation distance between the horizontal plane HL and the optical layer 42 may increase when the optical layer 42 becomes farther away from the light emitting element 31. The separation distance between the horizontal plane HL and the optical layer 42 may gradually decrease after reaching a center point.

A linear light image may become longer as the curvature of the optical layer 42 increases. This is because the distance that the light emitted from the light emitting element 31 is incident on the conversion unit 40 becomes long. Referring to FIG. 4, a point at which the light is incident on the conversion unit 40 may be farther away in the first direction with respect to the horizontal plane HL without a curvature in comparison with the case in which the optical layer is planar. That is, a point Q2 at which the light emitted from the light emitting element 31 is reflected at the reflective layer may be farther than a point Q1 at which the light intersects the horizontal plane HL. Accordingly, the length of the linear light may be controlled even when the resin layer is omitted.

FIGS. 5A to 5E are images of stereoscopic light which varies according to a change of a curvature of an optical layer.

Figure 5A:
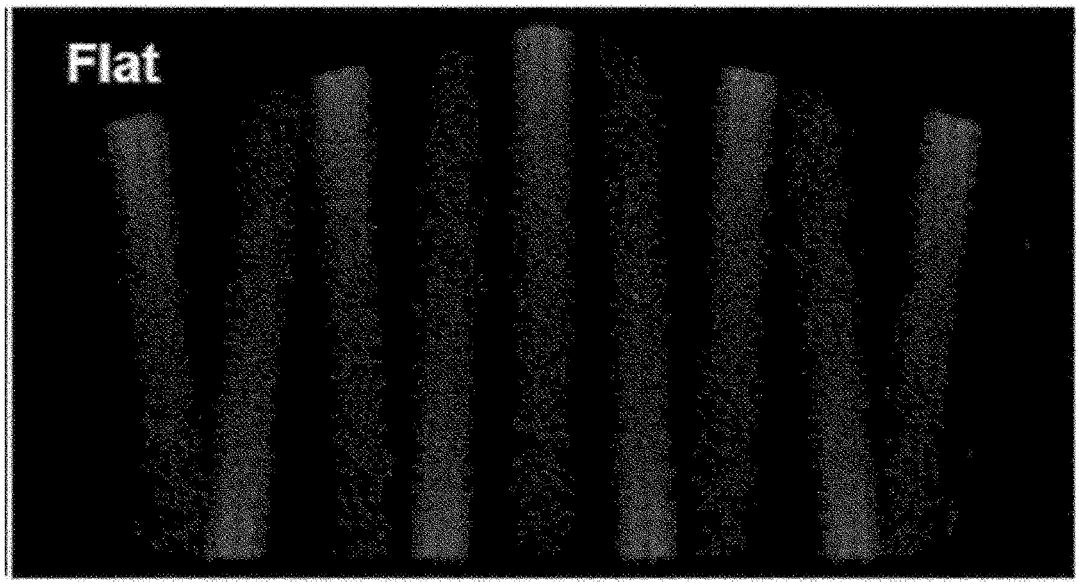
FIGS. 5A to 5E are images of stereoscopic light which varies according to a change of a curvature of an optical layer.
Figure 5B:
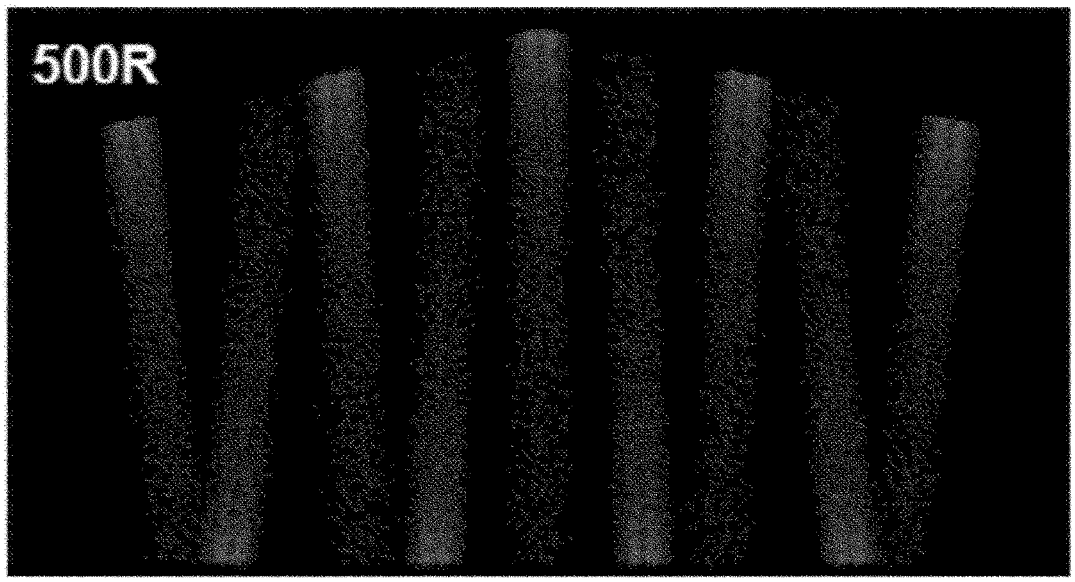

Referring to FIGS. 5A to 5E, as shown in FIG. 5A, when the conversion unit does not have a curvature, the length of the linear light is relatively short, but as shown in FIG. 5B, it may be confirmed that the length of the linear light may increase when a curvature radius is 500R. The curvature radius 500R may refer to a curvature degree of a circle with a radius of 500 mm. Accordingly, a curved line may be curved more when the curvature radius is smaller.

Figure 5C:
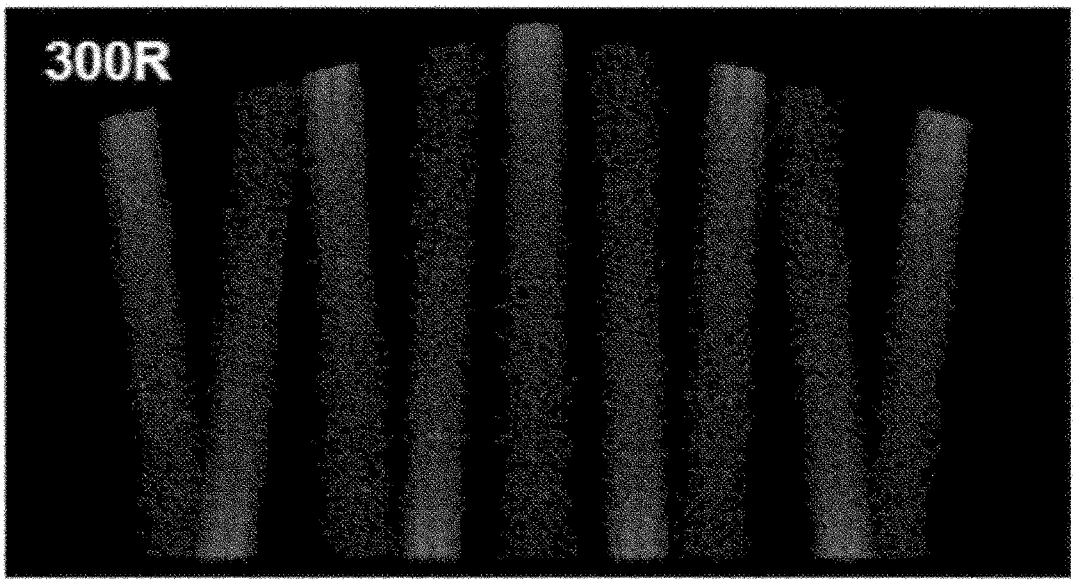
Figure 5D:
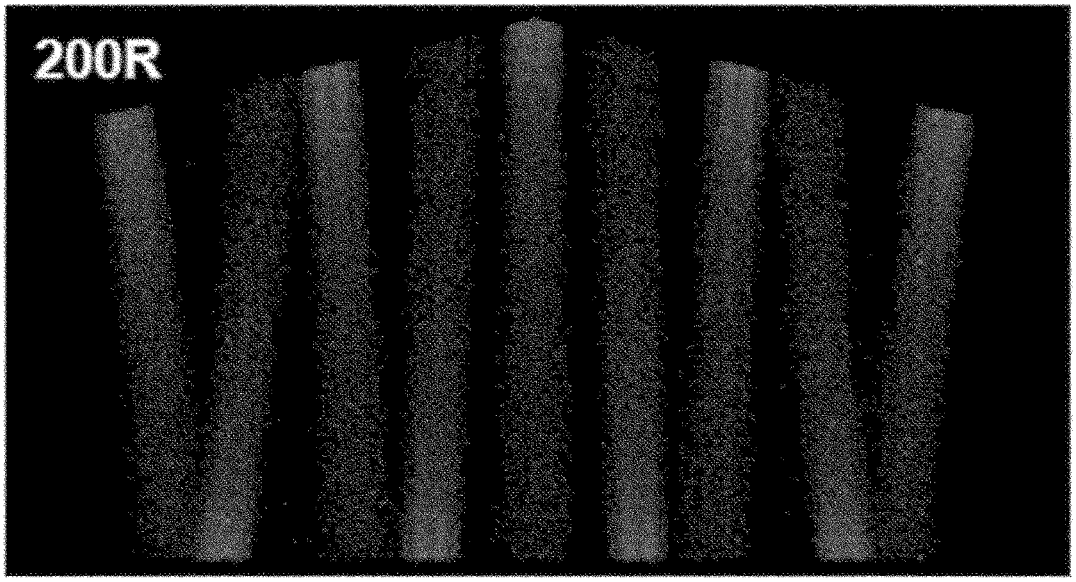
Figure 5E:
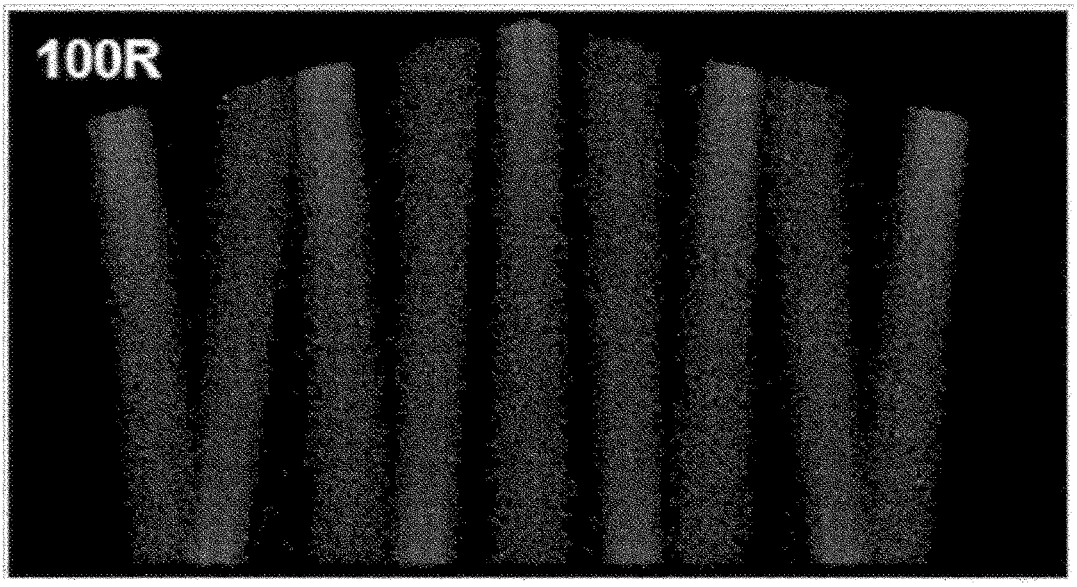

In the case in which the curvature radius is 300R as shown in FIG. 5C and in the case in which the curvature radius is 200R as shown in FIG. 5D, the length of the linear light may gradually become longer. Further, as shown in FIG. 5E, when the curvature radius is 100R, it may be confirmed that the length of the linear light may be significantly improved in comparison with FIG. 5A. That is, the length of the linear light may increase when the curvature radius decreases (the curvature increases).

Accordingly, according to the embodiment, a relatively longer linear light image may be obtained even when the resin layer covering the light emitting elements and the conversion unit is omitted. However, when the curvature radius decreases (the conversion unit is curved more), the linear light image is longer but the thickness of the lighting device increases. Accordingly, the curvature radius may preferably be in a range from 100R to 500R. When the curvature radius is smaller than 100R (for example: 10R), the thickness of the lighting device is too thick, and when the curvature radius is greater than 500R (for example: in the case of a flat surface), a sufficient linear light image is not obtained.

Figure 6:
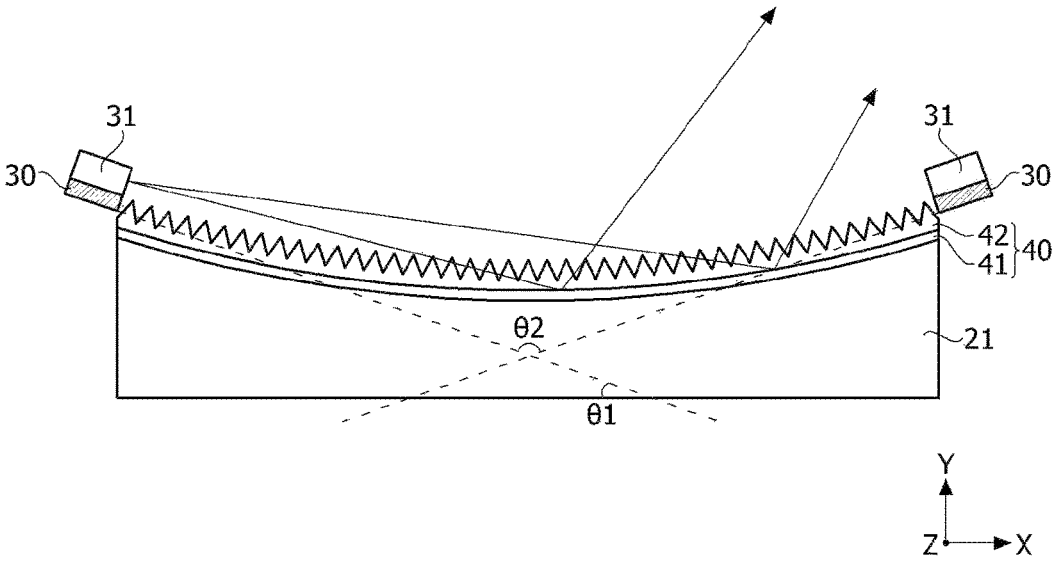
FIG. 6 is a modified example of FIG. 4.
Figure 7A:
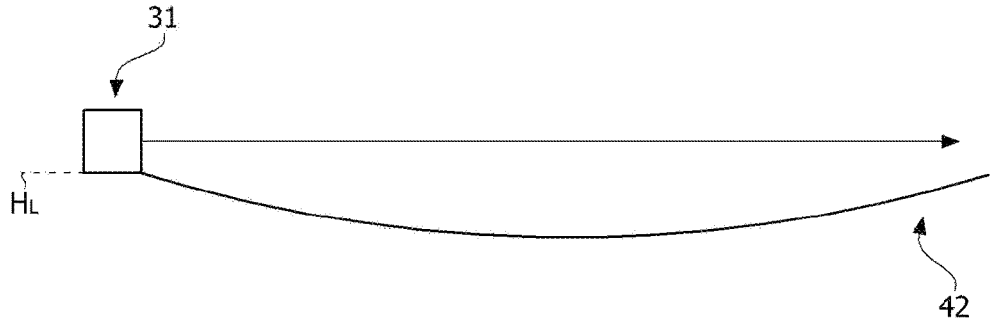
FIGS. 7A and 7B are views for describing a process in which a linear light image changes when a light emitting element is disposed inclined.
Figure 7B:
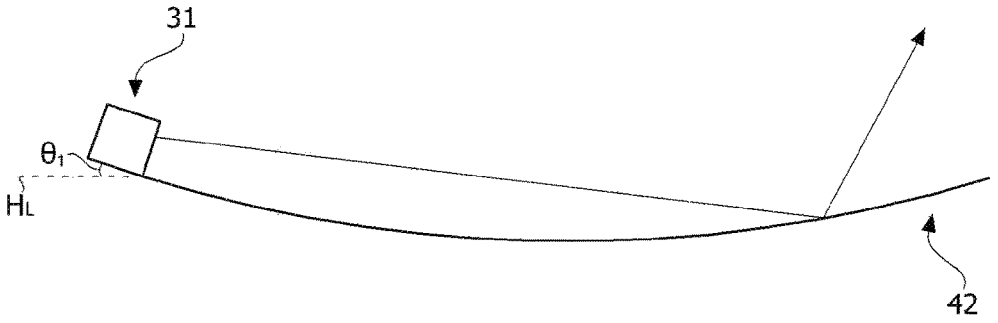
Figure 8A:
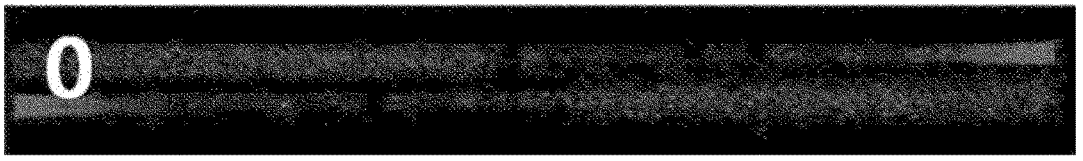
FIG. 8A is a light distribution image of a case in which a curvature of the optical layer is 300R and an inclination angle of the light emitting element is 0°.
Figure 8B:
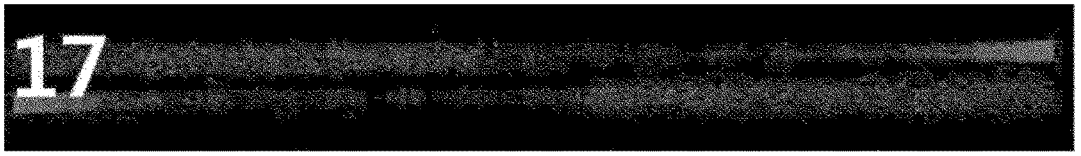
FIG. 8B is a light distribution image of a case in which the curvature of the optical layer is 300R and the inclination angle of the light emitting element is 17°.
Figure 8C:
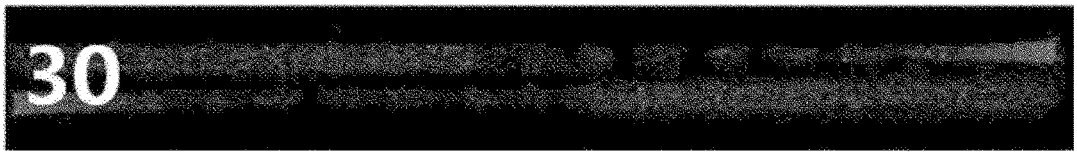
FIG. 8C is a light distribution image of a case in which the curvature of the optical layer is 300R and the inclination angle of the light emitting element is 30°.
Figure 8D:
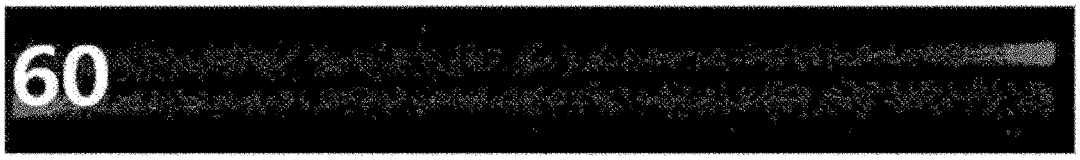
FIG. 8D is a light distribution image of a case in which the curvature of the optical layer is 300R and the inclination angle of the light emitting element is 60°.

FIG. 6 is a modified example of FIG. 4, and FIGS. 7A and 7B are views for describing a process in which a linear light image changes when a light emitting element is disposed inclined.

Referring to FIG. 6, in a lighting device according to another embodiment, light emitting elements 31 may be inclined toward an optical layer 42. According to the configuration, an amount of light emitted to the optical layer 42 having a curvature may be further increased. An angle Θ1 at which the light emitting element (or a circuit board) disposed at one side is inclined may be in a range from 1° to 30°. Further, an internal angle Θ2 formed by the angle at which the light emitting element (or the circuit board) disposed at one side is inclined and an angle at which the light emitting element (or the circuit board) disposed at the other side may be in a range from 120° to 178°.

Referring to FIG. 7A, when the light emitting element 31 is disposed to be parallel to a horizontal plane HL, light emitted parallel to the horizontal plane HL is not incident on the optical layer 42. However, when the light emitting element 31 is inclined toward the optical layer 42 by the predetermined angle Θ1, most of the light emitted from the light emitting elements 31 may be incident on the optical layer 42.

That is, since more light is incident on the optical layer 42 when the light emitting elements 31 are inclined, the emitted linear light may be clearer and longer. Further, a feeling of depth may be improved.

The following Table 1 is a table showing light distributions measured by varying an angle of the light emitting element according to the curvature radius of the optical layer.

TABLE 1

| | Curvature of optical layer | Angle of light emitting element | Luminous intensity (cd) |
|---|---|---|---|
| Embodiment 1 | 100R | 0 | 4.2 |
| Embodiment 2 | 100R | 30 | 5.14 |
| Embodiment 3 | 100R | 60 | 5.89 |
| Embodiment 4 | 100R | 75 | 6.06 |
| Embodiment 5 | 300R | 0 | 0.96 |
| Embodiment 6 | 300R | 17 | 0.94 |
| Embodiment 7 | 300R | 30 | 0.94 |
| Embodiment 8 | 300R | 60 | 0.82 |
| Embodiment 9 | 500R | 0 | 0.66 |
| Embodiment 10 | 500R | 10 | 0.53 |
| Embodiment 11 | 500R | 30 | 0.49 |
| Embodiment 12 | 500R | 60 | 0.39 |
| Embodiment 13 | flat | 0 | 0.83 |
| Embodiment 14 | flat | 30 | 0.72 |
| Embodiment 15 | flat | 60 | 0.45 |

Referring to Table 1, the light distribution (an H-V value) may increase as the curvature radius of the optical layer 41 decreases (the curvature increases). For example, as in Embodiment 15, when the optical layer 41 does not have a curvature, the light distribution is 0.45 cd even when the light emitting element 31 is disposed at a 60° inclination, whereas as in Embodiment 1, when the optical layer 41 has a curvature radius of 100R, light distribution may be roughly 4.2 cd even when the angle of the light emitting element 31 is 0°. Accordingly, when the optical layer 41 has a curvature, it is confirmed that the linear light image may be relatively improved.

Further, it may be confirmed that when the optical layer 41 has the same curvature, the light distribution is improved as the light emitting element 31 is inclined at a predetermined angle. For example, in the case of Embodiment 1, the light distribution is only 4.2 cd, whereas in the case of Embodiments 2, 3, and 4 in which the angle of the light emitting element 31 increases, it may be confirmed that the light distribution is improved.

In this case, when the curvature radius of the optical layer 41 is 100R, the linear light image is improved but the thickness of the optical layer may become too thick. Accordingly, the curvature radius of the optical layer 41 may be controlled to be in a range from 300R to 500R.

Referring to Table 1 and FIGS. 8A to 8D, when the angle is 60° as in Embodiment 8, it may be confirmed that the light distribution may decrease in comparison with Embodiment 7. Further, in FIG. 8D, it may be confirmed that the linear light image is blurred and is shortened in comparison with FIG. 8C. Accordingly, when the inclination angle Θ1 of light emitting element 31 is greater than 1° and smaller than 30°, it is advantageous in that the light distribution may be improved and a thin lighting device may be manufactured.

The lighting device of the embodiment is not limited to a lighting device of a vehicle and may be applied to inner and outer curved surface portions or curved portions of an target in which lighting is installed such as a building, equipment, furniture, or the like as a flexible film-shaped lighting device. In this case, an outer lens may be an optical guide part, an optical member in which the optical guide part, a stereoscopic effect-forming part, and a reflective part are combined, and/or a supporting member configured to support a light source part, or a housing. In this case, the outer lens may have a light transmission rate or transparency which is greater than or equal to a predetermined level so that the inside thereof is seen from the outside. The lighting device of the embodiment may serve as a taillight of a motorcycle.

Although preferable embodiments are described and shown above to exemplify the technical spirit of the present invention, the present invention is not limited to configurations and actions which are shown and described above, and those skilled in the art should understand that various suitable modifications and changes to the present invention may be performed without departing from the scope of the technical spirit. Accordingly, all such modifications and changes and the equivalents should be considered to be within the scope of the present invention.

An embodiment is directed to providing a lighting device having reduced manufacturing costs.

Further, an embodiment is directed to providing a lighting device capable of maintaining a length of linear light even when a resin is omitted.

Problems desired to be solved by the embodiment are not limited thereto-described problems, and objects and effects understood from solutions and embodiments which will be described below are also included.

One aspect of the present invention provides a lighting device including: a conversion unit including an optical layer having a plurality of optical patterns; a light emitting element configured to emit light toward the optical patterns; and a circuit board on which the light emitting element is disposed, wherein the plurality of optical patterns are disposed to be spaced apart from each other in a first direction, and extend in a second direction which intersects the first direction, and the optical layer has a curvature in the first direction.

A plurality of light emitting elements may be disposed in the second direction.

A curvature radius of the optical layer may be in a range from 100R to 500R.

The conversion unit may include a reflective layer configured to reflect light emitted from the light emitting element.

The lighting device may include a bracket including a first accommodation part in which the conversion unit is disposed and a second accommodation part in which the circuit board is disposed.

The lighting device may include a cover configured to expose the conversion unit and cover the circuit board.

The lighting device may include a block disposed in the first accommodation part to support the conversion unit.

The light emitted from the light emitting element may pass through the optical layer to be converted to linear light.

The light emitting element may be inclined toward the optical layer.

An angle at which the light emitting element is inclined toward the optical layer based on a horizontal plane may be in a range from 1° to 30°.

According to an embodiment, since a resin layer can be omitted and an area of a circuit board can be reduced, manufacturing costs can be reduced.

Further, a length of linear light can be maintained without a resin layer.

Various useful advantages and effects of the present invention are not limited thereto and may be understood relatively easily in the course of describing exemplary embodiments of the present invention.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting device comprising:

a conversion unit including an optical layer having a plurality of optical patterns;

a plurality of a light emitting elements configured to emit light toward the optical patterns; and a circuit board on which the plurality of the light emitting elements are disposed, wherein the circuit board comprises an outer shape having a pentagonal shape and an inner groove having the pentagonal shape, wherein the plurality of the light emitting elements are disposed at least three sides of the circuit board, and wherein light exit directions of the plurality of the light emitting elements disposed on each of the three sides are different from each other.

2. The lighting device of claim 1, wherein the plurality of optical patterns are disposed to be spaced apart from each other in a first direction, and extend in a second direction which intersects the first direction, and wherein the optical layer has a curvature in the first direction.

3. The lighting device of claim 2, wherein a curvature radius of the optical layer is in a range from 100R to 500R.

4. The lighting device of claim 3, wherein the conversion unit includes a reflective layer disposed on a lower surface of the optical layer.

5. The lighting device of claim 2, further comprising a bracket including a first accommodation part in which the conversion unit is disposed and a second accommodation part in which the circuit board is disposed, and wherein the optical layer is disposed below a lower surface of the circuit board.

6. The lighting device of claim 5, wherein a separation distance between a horizontal plane and the optical layer increase when the optical layer becomes farther away from the light emitting element.

7. The lighting device of claim 5, further comprising a cover configured to expose the conversion unit and cover the circuit board.

8. The lighting device of claim 2, wherein light emitted from the plurality of the light emitting elements is reflected or refracted by the conversion unit to be converted to linear light.

9. The lighting device of claim 8, wherein the plurality of the light emitting elements are inclined toward the optical layer.

10. The lighting device of claim 9, wherein an angle at which the light emitting element is inclined toward the optical layer based on a horizontal plane is in a range from 1° to 30°.

11. The lighting device of claim 9, further comprising a first light emitting device disposed on a first side of the conversion unit and a second light emitting device disposed on a second side of the conversion unit, and wherein an angle at which the first light emitting element and the second light emitting element are inclined is in a range from 120° to 178°.

12. The lighting device of claim 5, further comprising a block disposed in the first accommodation part and disposed between the bracket and the conversion unit.

13. The lighting device of claim 12, wherein the block comprises a first surface on which the conversion unit is provided, and wherein the first surface of the block has a curvature corresponding to the curvature of the optical layer of the conversion unit.

14. The lighting device of claim 13, wherein the block comprises a second surface opposite to the first surface and the second surface is flat.

15. The lighting device of claim 13, wherein a shape of the block corresponds to a shape of the conversion unit in a plan view.

16. The lighting device of claim 15, wherein the circuit board includes an inner groove corresponding to shapes of the block and the conversion unit.

* * * * *